United States Patent [19]

Collins et al.

[11] 4,335,903

[45] Jun. 22, 1982

[54] BOOK READER'S CLIP

[76] Inventors: David A. Collins; Robyn A. Collins, both of 42 Disraeli St., Auckland, New Zealand

[21] Appl. No.: 167,441

[22] Filed: Jul. 9, 1980

[30] Foreign Application Priority Data

Jul. 16, 1979 [NZ] New Zealand ..... 191020

[51] Int. Cl.[3] ..... B42D 9/00

[52] U.S. Cl. ..... 281/46; 281/42

[58] Field of Search ..... 281/46–49, 281/42

[56] References Cited

U.S. PATENT DOCUMENTS

| | | | |
|---|---|---|---|
| 316,499 | 4/1885 | Thomas | 281/42 |
| 992,916 | 5/1911 | Shiver | 281/42 |
| 1,793,520 | 2/1931 | Siptrott | 281/46 X |
| 2,089,457 | 8/1937 | Waters | 281/42 |
| 2,278,143 | 3/1942 | Matthews | 281/42 |
| 4,235,457 | 11/1980 | Brewer | 281/42 |

FOREIGN PATENT DOCUMENTS

| | | | |
|---|---|---|---|
| 100672 | 6/1916 | United Kingdom | 281/42 |

*Primary Examiner*—Paul A. Bell
*Assistant Examiner*—John S. Brown
*Attorney, Agent, or Firm*—Holman & Stern

[57] ABSTRACT

A clip including a body portion for positioning on the spine of a book and a tail portion positionable on the inner spine. A head portion is provided to extend laterally of the body portion and when placed over the inner corners of adjacent pages will hold them apart. The pages can be turned over with the clip retained on the spine and be received in a cavity between the tail portion and the head portion. The clip also provides a book page marker.

8 Claims, 5 Drawing Figures

BOOK READER'S CLIP

This invention relates to clip and has particular application to a clip for holding sheets of paper in a particular position, or for making or holding pages of a book.

There is a need for some means to hold a book open in such a manner that the book can be read without the need for the reader to hold both pages simultaneously. Furthermore, it is considered that is would be advantageous or desirable if such a means was capable of use as a book marker, and which additionally assisted in opening a book at a particular page.

It is an object of this invention to go some way towards meeting the abovementioned needs in providing an improved clip, or one which will at least provide the public with a useful choice.

In a further aspect, the invention provides a clip having an elongate body portion adapted to engage the outer spine of a book, and a head portion attached to the body portion wherein the head portion extends substantially laterally of said body portion to such an extent as to engage and hold adjacent pages of a book in an open position when the head portion is positioned over the pages, and wherein a tail portion is provided between said body portion and said head portion adapted to engage the inner spine of the book when in use.

In a further aspect, the invention provides a method of holding open adjacent pages of a book in which a clip is inserted along both the outer spine and inner spine of a book, with a head portion extending substantially laterally of said spine engaging the upper edge of both pages to hold the adjacent pages apart on either side of the spine.

Figure 1:
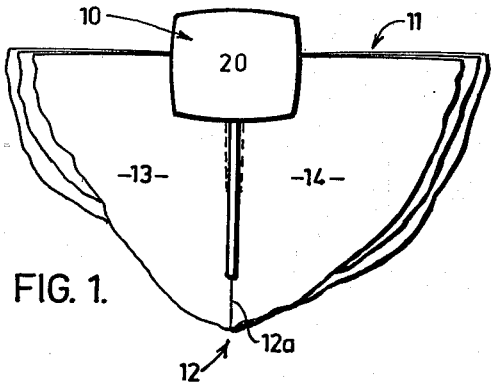

Other aspects of this invention which should be considered in all its novel aspects will become apparent from the following description, which is given by way of example only with particular reference to the accompanying drawings, in which:

FIG. 1: illustrates a preferred clip attach to a book in a first "holding" position.

Figure 2:
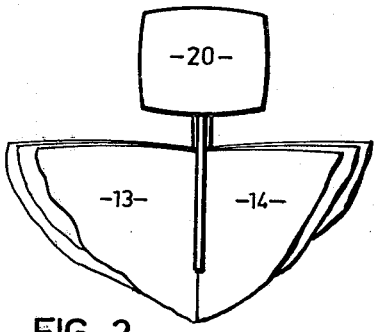

FIG. 2: illustrates the clip of FIG. 1 in a "marking" or "turning" position.

Figure 3:
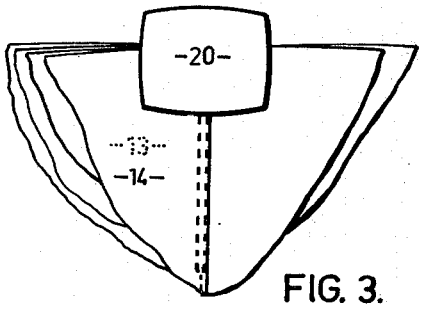

FIG. 3: illustrates the clip of FIG. 1 in a second "holding" position.

Figure 4:
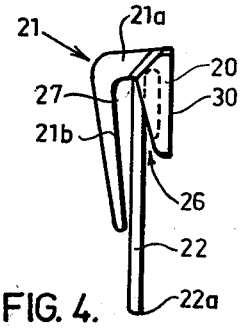

FIG. 4: illustrates the clip of FIG. 1 in side elevation.

Figure 5:
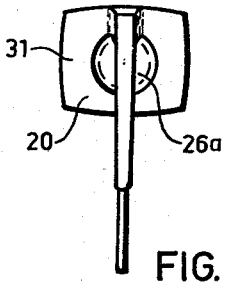

FIG. 5: illustrates the clip of FIG. 1 in rear elevation.

The invention in brief comprises a clip for holding sheets of paper in a particular position, or according to preferred embodiments, for marking, and/or holding open the pages of a book, which might be either hard bound or a paperback book. The invention comprises a clip which is generally integrally formed and which includes a body portion so shaped as to extend along the outer spine of a book, or alternatively down the back of a number of sheets of collated paper. The invention includes a head portion which is spaced apart from the body portion a sufficient distance such that the thickness of a spine of a book may be positioned between the body portion and the head portion. The head portion is of sufficient dimension to engage and hold the top inner corners of adjacent pages of a book so that the book is maintained in an open position when the head portion is positioned over the pages.

The invention then provides a tail portion between the body portion and the head portion which tail portion is resilient and is capable of engaging the inner spine of a book when the clip is in use. The arrangement is thereby such that the spacing between the body portion and the tail portion is capable of receiving the thickness of the spine of the book, and the head portion may then be used to hold open the pages of the book when the clip is fully lowered into position on a book. The spacing between the tail portion and the head portion is then capable of receiving additional pages of the book as it is read, so that consecutive pages may be held open by the head portion, while the body and tail portions remain as originally positioned.

Now with particular reference to the drawings, there is illustrated in FIG. 1, one preferred embodiment of the clip 10 attached to a book, generally indicated by arrow 11. The clip is adapted to fit on the spine of a book generally indicated by arrow 12 and to hold the book open at for example pages 13, and 14 in the position shown in FIG. 1 of the drawings.

The clip consists of a head portion 20 which may be of any shape provided that it is of sufficient width to partially overlap the upper inside corners of two pages of a book. It will therefore be appreciated that the only relevant dimension is that of the lower portion of the head, so that the remainder of the head portion may be of any shape which may be required as to indicate a particular manufacturing design, or to receive advertising or other promotional material secured to or integrally formed with the face of the head portion 20.

In the preferred form of the invention the head portion 20 is attached to, or preferably integrally formed with a body portion generally indicated by arrow 21 which includes a neck portion **21*a*, and a downwardly depending elongate member 21*b* as shown in FIG. 4** of the drawings. Furthermore, it will be appreciated that according to a preferred embodiment of the invention the clip may be integrally formed of the same material, for example being moulded of a plastics material or metal or the like.

Now, with further reference to FIG. 4 of the drawings, there is provided a tail portion 22, which is joined, or preferably integrally formed as a portion of the clip. The tail portion 22 extends as an elongate member from the neck portion **21*a* and between the body portion 21 and the head portion 20 so as to provide a rear cavity 27 and a front cavity 26. The tail portion 22 is of a slender elongate shape which is tapered at its distal end 22*a*, to facilitate the convenient insertion of the tail portion between the pages of a book without damaging same. Furthermore, the arrangement of the clip is such that the rear cavity 27, that is to say the space between the body 21 and the tail 22 is somewhat less deep than the cavity 26**, the advantages of which will become apparent from the ensuing description.

Furthermore, in the preferred form of the invention, the tail member 22 is of resilient construction and is shaped to depend downwardly on the inner spine of a book. The clip of the preferred form of the invention therefore provides that the body portion 21, and particularly the downwardly depending elongate member **21*b* is of a more rigid construction, and adapted to curve inwardly towards the rear of the tail portion 2. This provides that the width of the spine of a book may be positioned in the cavity 27 and firmly gripped there between even when the spine is only positioned in the entry portion of the cavity. That is, the angle of the elongate body portion 21*b* relative to the tail portion 22 provides a tapered cavity 27 wherein the book is gripped between the distal end of the head portion 21*b* and the shank of the tail portion 22**.

In the preferred form of the invention the tail portion 22 extends outwardly beyond the distal end of the elongate head portion 21*b* so that upon insertion of the clip on a book, the tail portion 22 is firstly inserted in the inner spine, before the elongate body portion 21*b* is clipped over the outer spine of the book, so as to engage the thickness of the spine between the body portion and the tail portion.

The operation of this clip according to the preferred embodiment, will now be described with reference to FIGS. 1, 2 and 3 of the drawings. Firstly, with reference to FIG. 1, a book 11 can be opened at for example pages 13 and 14, and the clip attached to the book by sliding the tail portion 22 along the inside spine 12*a*, and then clipping the elongate body portion 21*b* over the outer spine of the book. It will be appreciated that reference to the inner spine will be to the joint between the pages of the book. The clip can then be slid down the pages of the book until pages 13 and 14 are positioned between the tail 22 and the body portion 21, and with the end of the spine in rear cavity 27 when the clip is pushed down to the position shown. Then, the pages 13 and 14 are marked by the tail portion 22 and are held apart by the head portion 20 pressing on the upper inside corners of both pages 13 and 14.

Now, with reference to FIG. 2 of the drawings, where it is desired to turn over page 14, then the clip can be slid upwardly to the position shown. It will be appreciated that in this position, the spine of the book is still retained between the distal end of the elongate body portion 21*b*, and the shank of the tail portion 22, so that the clip is not totally removed from the book, nor will it slip off the spine without further movement. Thereafter, page 14 can be turned over and placed on top of page 13 so that the tail portion 22 remains between those pages, and is thus covered by the page which has been turned over. The clip can then be slid down again over the new pages which have been exposed which are in turn positioned in the cavity 26 between the tail 22 and the head portion 20, as shown in FIG. 3 of the drawings. In this position, the head portion 20 again holds apart the two new pages which are exposed by pressing on upper inside corners of these new pages.

It will now be appreciated that the greater depth of cavity 26 means that the new pages, or a plurality thereof can be readily positioned within the cavity 26 without damage to the edges thereof as the reader continues reading the book and placing further pages in the cavity. That is, the upper edges will not contact the top of the cavity 26.

It will be appreciated that the operation of the invention as described with reference to FIGS. 2 and 3 can be repeated as the person continues to read the book. Thereafter, when a number of pages have been turned over and positioned within cavity 26 so that it becomes full, the clip may be completely removed from the book and conveniently replaced in the position shown in FIG. 1 on the pages which have been reached by the reader.

It will be appreciated that with reference to the operation of the invention, the dimensions of the face of the head member will be such that the clip may be easily mounted up and down in relation to the pages by the readers, so that the turning of the pages in movement of the clip can be carried out in a simple and convenient manner without requiring much attention on the part of the reader.

Furthermore, with particular reference to FIGS. 4 and 5 of the drawings, it will be seen that the head portion 20 is provided with front face 30 and rearwardly depending side portions 31, between which there is a recess 26*a* forming the upper portion of the cavity 26. Additionally, the side portions 31 taper outwardly towards the front face 30 so as to permit the convenient positioning of the pages into the cavity 26. It will then be appreciated that the side portions 31 rest on the pages so as to maintain them in an open position, whilst the recess 26*a* does not press against the folds in the pages so as to damage the book.

When the reader is finished or for example only wishes to mark his page, the clip may be withdrawn, with tail 22 remaining in the page the reader wishes to mark. With the clip left in this position (shown in FIG. 2 of the drawings), the tail 22 will be held between the pages and the width of the tail portion will assist in opening the book to the required page when desired. However, the weight of the pages will still hold the book closed when it is lying flat.

Further, it will be appreciated that the positioning of the spine of the book in cavity 27 is such that the clip is not easily dislodged when it is being used as a marker.

It will therefore be appreciated that the clip of this invention can be used either as a means for holding the pages of a book in a particular position whilst reading and/or as a convenient book mark to enable the book to be readily opened at a particular page.

Furthermore, the device according to the invention can by used with all types of books, and additionally in relation to pages of documents, and all other types of publications, although it has particular use in relation to publications including a spine, or other type of construction which provides a join between the pages.

Finally, it will be appreciated that modifications, alterations and additions may be made without departing from the scope of the invention.

We claim:

1. A book readers clip including:

an elongate body portion extending to one side of, adjacent one end of, a neck portion; and a head portion being substantially shorter than said elongate body portion but extending to the same side of, adjacent the other end of, said neck portion, said head portion extending laterally of said neck portion to such an extent as to extend over adjacent pages of a book, and;

an elongate tail portion extending from the same side of the neck portion, and intermediate between and spaced apart from the body portion and the head portion; characterised in that said elongate body portion defines first and second juxtaposed recesses, said first recess being between said body portion and said tail portion and adapted to receivably engage the spine of a book, and said second recess being between the tail portion and the head portion and adapted to receive the pages of a book.

2. A book readers clip as claimed in claim 1 wherein the base of the second recess is further recessed into the neck portion than the base of the first recess.

3. A book readers clip as claimed in claim 1 wherein the tail portion is resilient and is approximately the same length or of greater length than the elongate body portion.

4. A book readers clip as claimed in claim 3 wherein the elongate body portion is bent towards the tail portion to provide a restricted resilient entry into the first recess.

5. A book readers clip as claimed in claim 1 wherein the head portion is provided with a front face, and a rear face adjacent the neck portion, said rear face including protrusions on each side of the neck portion, said protrusions being tapered towards a lower edge of the front face.

6. A book readers clip as claimed in claim 5 wherein the inwardly tapered protrusions on each side of the rear face of the head portion provide a restricted entry in to the second recess.

7. A book readers clip as in any one of the preceding claims 1 to 6 wherein the opening into the first recess is outwardly of the opening into said second recess.

8. A book readers clip as claimed in any of the preceding claims 1 to 6 integrally formed of resilient plastics material.

* * * * *

UNITED STATES PATENT AND TRADEMARK OFFICE

CERTIFICATE OF CORRECTION

PATENT NO. : 4,335,903

DATED : June 22, 1982

INVENTOR(S) : DAVID ALLAN COLLINS, et al.

It is certified that error appears in the above—identified patent and that said Letters Patent is hereby corrected as shown below:

On The Title Page,

" [30] Foreign Application Priority Data
Jul. 16, 1979 [NZ] New Zealand..... 191020"

SHOULD BE:

-- [30] Foreign Application Priority Data
Jul. 16, 1979 [NZ] New Zealand..... 191030 --.

Signed and Sealed this

*Thirty-first* Day of *August 1982*

[SEAL]

*Attest:*

GERALD J. MOSSINGHOFF

*Attesting Officer*

*Commissioner of Patents and Trademarks*